US007632137B1

(12) United States Patent
Ma et al.

(10) Patent No.: US 7,632,137 B1
(45) Date of Patent: Dec. 15, 2009

(54) POWER ADAPTER

(75) Inventors: Jian-Rong Ma, Tu-Cheng (TW); Hua-Hu Wei, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/219,723

(22) Filed: Jul. 28, 2008

(51) Int. Cl.
*H01R 29/00* (2006.01)

(52) U.S. Cl. ..... 439/518

(58) Field of Classification Search ..... 439/518, 439/172, 171, 173
See application file for complete search history.

(56) References Cited

U.S. PATENT DOCUMENTS 6,328,581 B1 * 12/2001 Lee et al. ..... 439/106
6,592,386 B2 * 7/2003 Teng et al. ..... 439/172
6,669,495 B2 * 12/2003 Philips et al. ..... 439/170
6,923,667 B1 * 8/2005 Chen ..... 439/172
6,935,878 B2 * 8/2005 Hsu et al. ..... 439/171
6,942,508 B2 * 9/2005 Wong ..... 439/171
7,168,969 B1 * 1/2007 Wang ..... 439/173
7,273,384 B1 * 9/2007 So ..... 439/172
7,381,059 B2 * 6/2008 Wong ..... 439/22
2004/0110413 A1 * 6/2004 Brandstatter et al. ..... 439/518

* cited by examiner

*Primary Examiner*—T C Patel
*Assistant Examiner*—Vladimir Imas
(74) *Attorney, Agent, or Firm*—Rosenberg, Klein & Lee

(57) ABSTRACT

A power adapter has a main body of cylindrical shape. A top of the main body defines a recess and an annular sidewall enclosing the recess. A rotation-proof component received in the annular sidewall of the main body defines a rotation-proof portion extending into the recess. A plug is rotatably mounted in the recess, and a side of the plug defines at least one rotation-proof recess. The plug is rotatably secured in the recess then the rotation-proof portion is elastically pressed against the plug and finally the rotation-proof portion is released into the rotation-proof recess for restraining the plug from reverse rotation.

4 Claims, 5 Drawing Sheets

POWER ADAPTER

BACKGROUND OF THE INVENTION

1. Field of the Invention

The present invention relates to a power adapter, and more particularly to a power adapter which can make a plug and a main body thereof to be engaged with each other firmly.

2. The Related Art

Generally, a power adapter is always used for adapting different sockets provided in different countries when one traveling all over the world. Therefore, a plug of the power adapter for connecting with the socket also must be exchangeable for adapting. At present, the power adapter generally includes a main body and a plug rotatably mounted to the main body. The main body has an opening, and a side of the plug has an arm with a protruding portion located on an end thereof and away from the main body. A guiding recess in the main body is the pathway passed by the arm and the protruding portion so that the protruding portion is wedged into the opening for preventing the plug from reverse rotation.

However, such assembling structure needs a biggish space so as to add the volume of the main body, which is not only inconvenient for user to carry the adapter during traveling, but also restrains other electrical devices from connecting with the socket when the power adapter is connected to the socket. In additional, in assembly or disassembly, the protruding portion is necessary to be pressed down firstly so that the plug can rotate with respect to the main body, which is not quite convenient for user to use.

SUMMARY OF THE INVENTION

Accordingly, an object of the present invention is to provide a power adapter which has a better assembling structure for fixing a plug to a main body thereof which can simplify the process of assembly and disassembly of the plug to the main body. A top of the main body defines a recess and an annular sidewall enclosing the recess. A rotation-proof component received in the annular sidewall of the main body defines a rotation-proof portion extending into the recess. The plug is rotatably mounted in the recess, and a side of the plug defines at least one rotation-proof recess. The plug is located by rotation in the recess, then the rotation-proof portion is elastically pressed against the plug and finally the rotation-proof portion is released into the rotation-proof recess for restraining the plug from reverse rotation.

As described above, the plug is assembled to an end of the main body, the power adapter shows a pillar shape in its entirety. When the power adapter is used to connect with a socket, the power adapter occupies smaller space horizontally so as to avoid having an influence on the connection between other electrical devices and the socket. Furthermore, the power adapter is assembled by the engagement between the rotation-proof portion and the rotation-proof recess to prevent reverse rotation, which simplifies the process of assembly and disassembly of the plug with the main body.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE EMBODIMENTS

Figure 1:
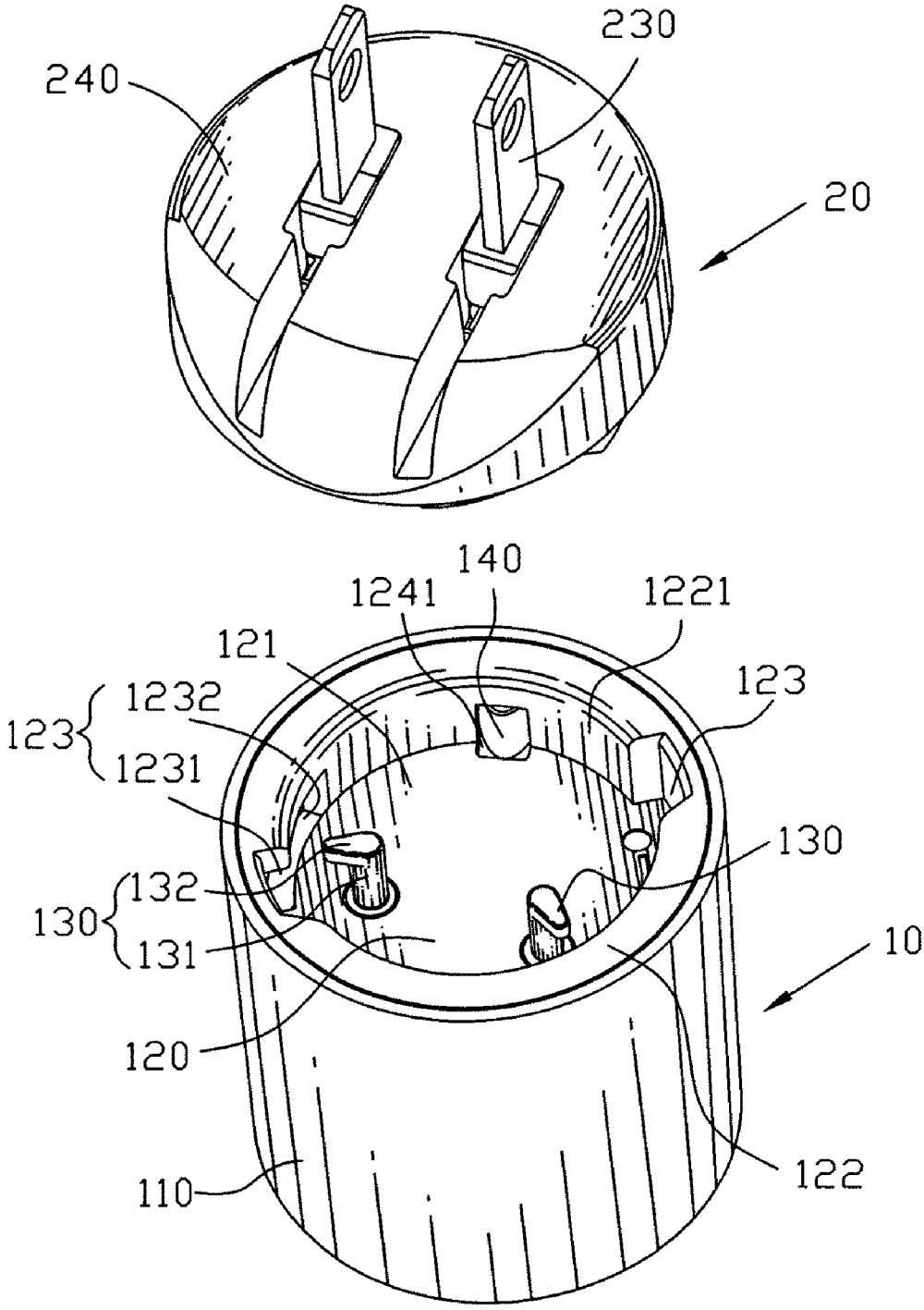
FIG. 1 is a schematic view showing a power adapter in an embodiment according to the present invention.

With reference to FIG. 1, a power adapter includes a case 10 and a plug 20 engaged with the case 10. The case 10 has a main shell 110, a main body 120 mounted in the main shell 110 and a plurality of main terminals 130 received in the main body 120.

Figure 2:
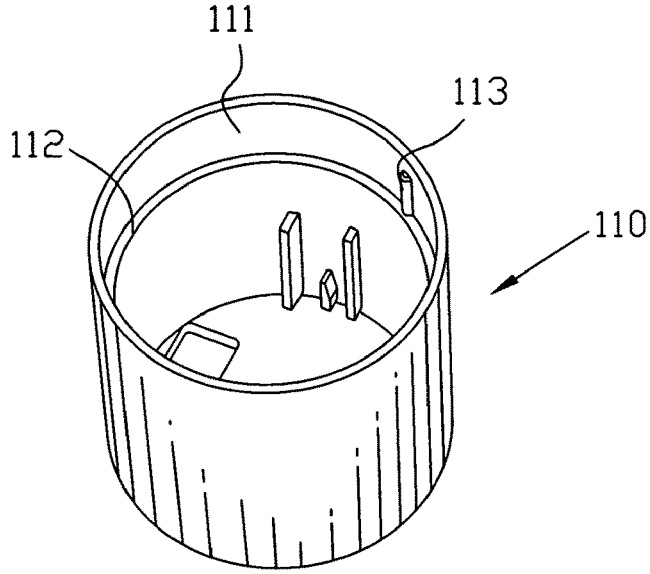
FIG. 2 is a perspective view of a main shell of the power adapter shown in FIG. 1.

Please refer to FIG. 1 and FIG. 2, the main shell 110 is cylindrical and defines an inner side 111 of circular shape. The inner side 111 has a platform 112 therearound for supporting the main body 120 thereon. An upper portion of the inner side 111 protrudes outwards (namely, protrudes toward the center of the circular inner side 111) to form at least one stopping strip 113 adjacent to the platform 112 and extended along an axis of the circular inner side 111. In this embodiment, there are two stopping strips 113 arranged diametrically symmetrically at the inner side 111.

Figure 3:
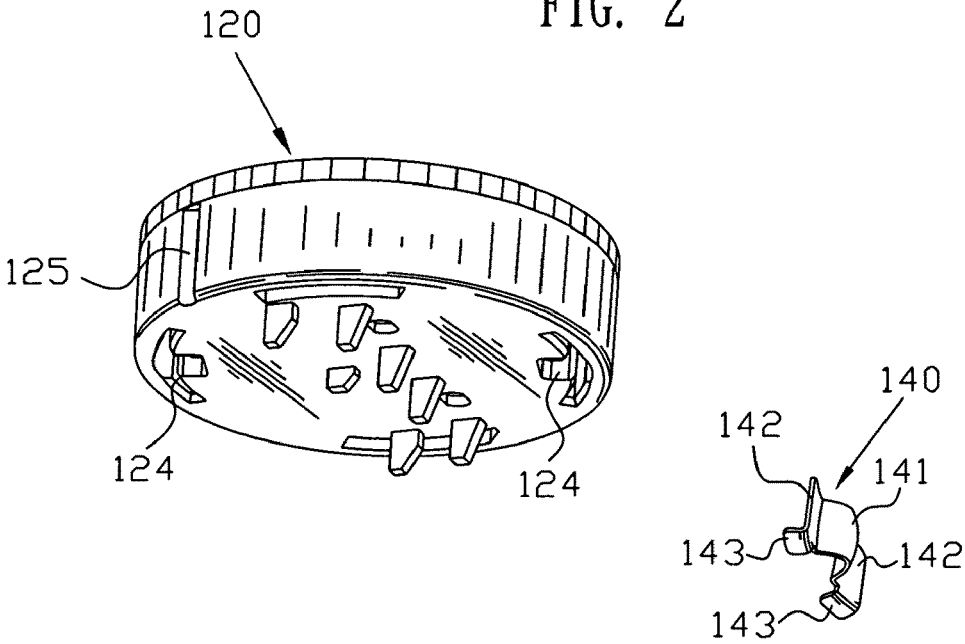
FIG. 3 is a perspective view of a main body of the power adapter shown in FIG. 1 while seen from a bottom view, wherein a rotation-proof component is arranged at an opposite side thereof.

Please refer to FIGS. 1-3, the main body 120 is of pillar (or in other word, cylindrical) shape and defines a recess 121 therein and an annular sidewall 122 enclosing the recess 121. The annular sidewall 122 defines an inner surface 1221 therefrom and the inner surface 1221 is recessed inwards to form two fixing recesses 123 and two receiving recesses 124, respectively and symmetrically. The fixing recess 123 includes a guiding recess 1231 passing through a top of the annular sidewall 122, and a sliding recess 1232 communicating with the guiding recess 1231 and running circumferentially. Namely, the sliding recess 1232 extends along the circumferential direction of the annular sidewall 122 and is adjacent to a bottom surface of the recess 121. The receiving recess 124 has an opening 1241 formed at the inner surface 1221. The receiving recess 124 is opened downwards to reach a bottom surface of the main body 120. An outer side of the annular sidewall 122 has at least one stopping cavity 125 corresponding to the stopping strip 113. The stopping cavity 125 is adapted to receive the stopping strip 113 for preventing the main body 120 from rotating with respect to the main shell 110.

The main terminal 130 includes a supporting portion 131 fixed in the bottom surface of the recess 121 and a contacting portion 132 extending perpendicularly from a free end of the supporting portion 131. The supporting portion 131 is of cylindrical shape. The contacting portion 132 extends along the radial direction of the main body 120.

The case 10 further has a rotation-proof component 140 disposed in the receiving recess 124. The rotation-proof component 140 defines a rotation-proof portion 141 of arc shape. Both ends of the rotation-proof portion 141 respectively extend outwards to form a fixing end 142. A side of the fixing end 142 bends opposite to the rotation-proof portion 141 and extends to form a fixing portion 143. When the rotation-proof component 140 is assembled in the receiving recess 124, the fixing ends 142 are received in the receiving recess 124, and the rotation-proof portion 141 protrudes in the recess 121 through the opening 1241, and the fixing portions 143 are sandwiched between the platform 112 and the bottom surface of the main body 120 for fastening the rotation-proof component 140.

Figure 4:
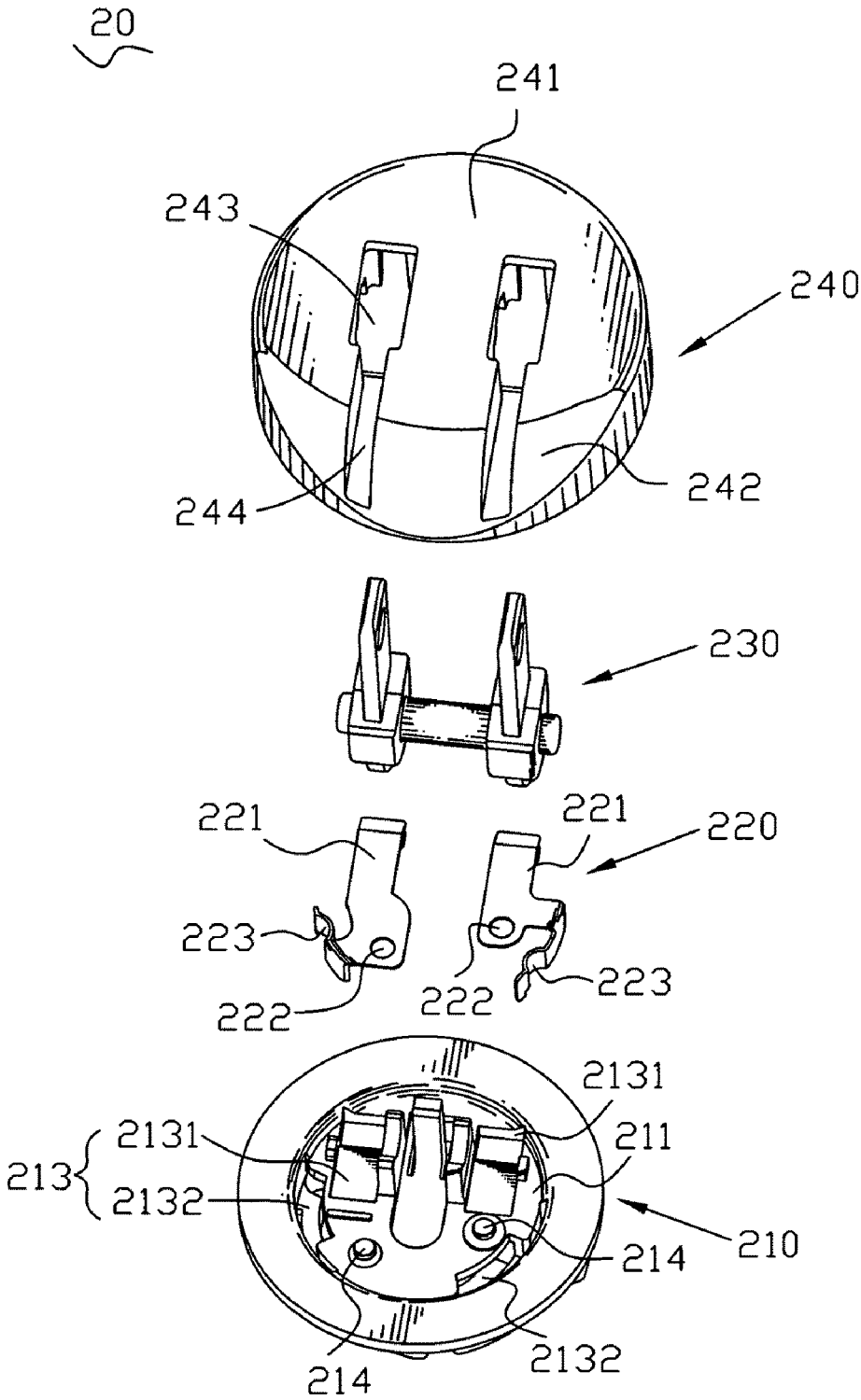
FIG. 4 is an exploded, perspective view of a plug of the power adapter shown in FIG. 1.
Figure 5:
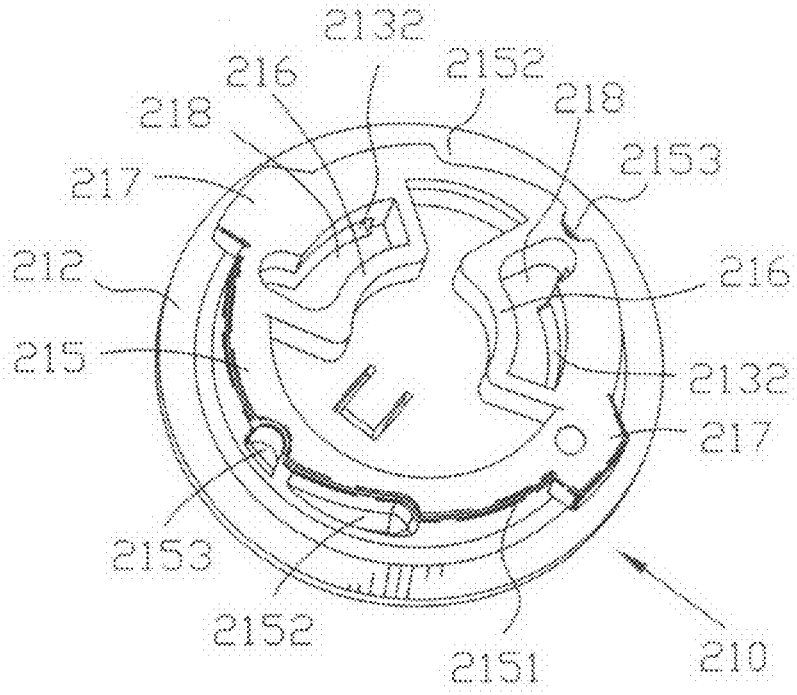
FIG. 5 is a perspective view of a plug body of the plug shown in FIG. 4 and seen from a bottom view.
Figure 6:
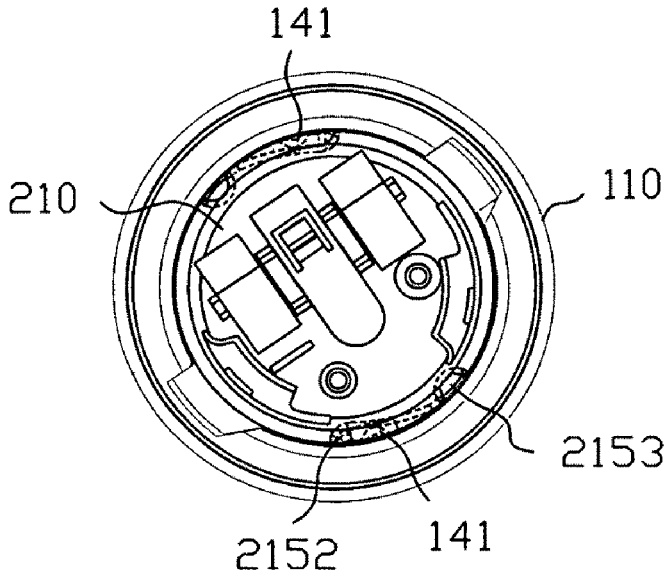
FIG. 6 is a schematic view illustrating a rotation-proof portion sliding in a leading recess shown by a dotted line.
Figure 7:
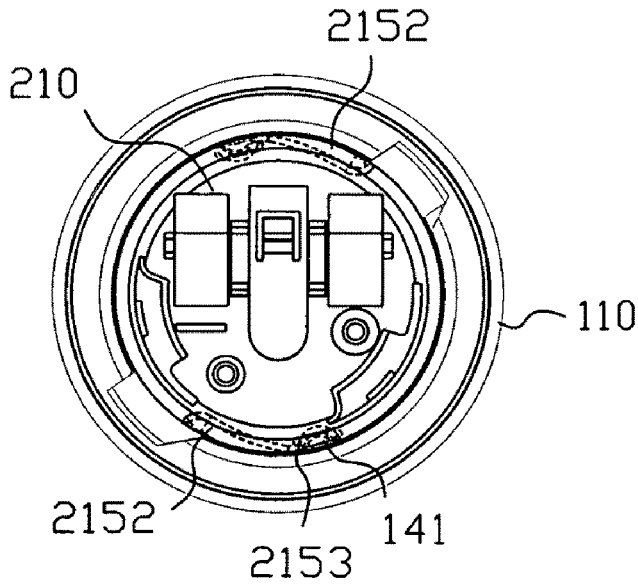
FIG. 7 is a schematic view illustrating the rotation-proof portion received in a rotation-proof recess shown by a dotted line.

Please refer to FIG. 4 and FIG. 5, the plug 20 includes a plug body 210, two conductive terminals 220 and connecting terminals 230 and a cover 240. The connecting terminal 230 is located at the plug body 210, and a free end of the connecting terminal 230 protrudes out of the cover 240 for electrically connecting with a socket (not shown).

The plug body 210 is of disk shape and defines a top surface 211 and a bottom surface 212. The top surface 211 has two conductive recesses 213 corresponding to the conductive terminals 220. The conductive recess 213 includes a first cavity 2131 and a second cavity 2132. The first cavity 2131 is recessed downwards from the top surface 211 to show a substantial oblong shape. The second cavity 2132 is an arc-shape and recessed downwards from the top surface 211 to pass through the bottom surface 212. The top surface 211 has two fixing columns 214 respectively located near the conductive recess 213 for positioning the conductive terminal 220.

The bottom surface 212 extends downwards to form a first extension portion 215 and a second extension portion 216. The first extension portion 215 is substantially a ring shape and defines an outer side 2151. The outer side 2151 is concaved toward the centerline of the first extension portion 215 to form a leading recess 2152 and a rotation-proof recess 2153 adjacent to the leading recess 2152. In this embodiment, the first extension portion 215 has two leading recesses 2152 and rotation-proof recesses 2153 arranged, respectively and symmetrically. The rotation-proof recess 2153 is adapted to receive the rotation-proof portion 141 of the rotation-proof component 140. The leading recess 2152 extends along the circumferential direction of the first extension portion 215 with the width thereof decreased gradually; a narrow end of the leading recess 2152 is adjacent to the rotation-proof recess 2153. The outer side 2151 protrudes outwards to form two protrusion portions 217 arranged symmetrically for mating with the corresponding fixing recesses 123. The second extension portion 216 is disposed in the ring formed by the first extension portion 215 and is connected with the first extension portion 215 to form a receiving cavity 218 corresponding to the main terminal 130. The receiving cavity 218 communicates with the second cavity 2132. A bottom surface of the second cavity 2132 is lower than a bottom surface of the receiving cavity 218 to form a space for allowing the contacting portion 132 sliding therein.

The conductive terminal 220 defines a basic plate 221. The basic plate 221 is substantially rectangular and received in the first cavity 2131. An end of the basic plate 221 has a through hole 222 mating with the fixing column 214 for positioning the conductive terminal 220. A side of the basic plate 221 extends downwards to form a connecting piece 223 near the through hole 222. The connecting piece 223 is an arc shape and received in the second cavity 2132 for electrically connecting with the contacting portion 132 of the main terminal 130.

The cover 240 coupled with the plug body 210 defines an upper surface 241 and a gradient surface 242 connecting with the upper surface 241. The upper surface 241 has two connecting holes 243 corresponding to the connecting terminals 230. Each of the connecting holes 243 extends toward the gradient surface 242 to form a holding recess 244. The holding recess 244 passes through the gradient surface 242 and is used to receive the connecting terminal 230 when the power adapter is not in use.

Please refer to FIG. 1 and FIGS. 5-7, when the user wants to assemble the case 10 and the plug 20 together, firstly, the plug 20 has to be adjusted to be located in a first position where the protrusion portions 217 are respectively wedged into the guiding recesses 1231 and the rotation-proof portion 141 mates with the leading recess 2152. At this time, the contacting portion 132 of the main terminal 130 is inserted into the receiving cavity 218. Then the user can clockwise rotate the plug 20 an angle with respect to the case 10 so that the plug 20 will be changed in a second position where the rotation-proof portion 141 slides away from the leading recess 2152 to the rotation-proof recess 2153 and the protrusion portion 217 slides into the sliding recess 1232. The rotation-proof portion 141 is released into the rotation-proof recess 2153 so as to be elastically pressed against the plug 20 for restraining the plug 20 from reverse rotation. Thus the plug 20 can be mounted to the case 10 steadily and the contacting portion 132 slides on the bottom surface of the second cavity 2132 for electrically connecting with the connecting piece 223. When the plug 20 is needed to be taken away from the case 10, a counterclockwise force is applied to the plug 20, and the rotation-proof portion 141 is elastically pressed back and slides to the first position in initial way so that the plug 20 disengages from the case 10.

As described above, the plug 20 is mounted to an end of the case 10, the power adapter is a pillar shape on the whole. When the power adapter is used to connect with the socket, the power adapter occupies smaller space horizontally, thus avoiding influence on connection between other electrical devices and the socket. Furthermore, the power adapter is assembled by the engagement between the rotation-proof portion and the rotation-proof recess to prevent reverse rotation, which simplifies the process of assembly and disassembly of the plug 20 and the case 10. In addition, the connecting terminals 230 of the plug 20 are capable of rotating to be received in the holding recess 244 of the cover 240, which is more convenient for user to carry during traveling.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A power adapter comprising:

a main body of cylindrical shape, a top of the main body defining a recess, and an annular sidewall enclosing the recess;

a rotation-proof component which is received in the annular sidewall of the main body and which defines a rotation-proof portion extending into the recess;

a plug rotatably mounted in the recess, a side of the plug defining at least one rotation-proof recess; and, a main shell having a platform formed at an inner side thereof for supporting the main body thereon, the rotation-proof component further having two fixing portions extending oppositely from two ends of the rotation-proof portion and extending out of a bottom of the annular sidewall and bending towards the platform for being sandwiched between the bottom of the annular sidewall and the platform;

wherein the rotation-proof portion is elastically pressed against the plug as the plug rotates in the recess, and is then released into the rotation-proof recess for restraining the plug from reverse rotation.

2. A power adapter comprising:

a main body of cylindrical shape, a top of the main body defining a recess, and an annular sidewall enclosing the recess;

a rotation-proof component which is received in the annular sidewall of the main body and which defines a rotation-proof portion extending into the recess; and a plug rotatably mounted in the recess, a side of the plug defining at least one rotation-proof recess;

wherein the rotation-proof portion is elastically pressed against the plug as the plug rotates in the recess, and is then released into the rotation-proof recess for restraining the plug from reverse rotation;

wherein the side of the plug defines a leading recess extending along a circumferential direction with the width thereof decreased gradually, a narrow end of the leading recess is adjacent to the rotation-proof recess, and the rotation-proof portion slides away from the leading recess to the rotation-proof recess.

3. The power adapter as claimed in claim 2, wherein the rotation-proof portion is of an arc shape allowing the rotation-proof portion sliding into or out of the rotation-proof recess smoothly.

4. The power adapter as claimed in claim 1, wherein an inner surface of the annular sidewall defines at least one sliding recess along a circumferential direction thereof, and at least one guiding recess communicates with one end of the sliding recess and passes through a top of the annular sidewall, and a side of the plug protrudes to form at least one protrusion portion which is inserted into the sliding recess through the guiding recess and then slides along the sliding recess until the rotation-proof portion is released into the rotation-proof recess.

* * * * *